US005207729A

United States Patent [19]

Hatanaka

[11] Patent Number: 5,207,729

[45] Date of Patent: May 4, 1993

[54] CIRULATING TYPE WATER FLOW POOL

[76] Inventor: Miyoshi Hatanaka, 22-19, Matsubara 5-chome, Setagaya-ku, Tokyo 156, Japan

[21] Appl. No.: 741,586

[22] Filed: Aug. 7, 1991

[30] Foreign Application Priority Data

Aug. 15, 1990 [JP] Japan ..... 2-215306
Jun. 3, 1991 [JP] Japan ..... 3-159970

[51] Int. Cl.[5] ..... E04H 4/12

[52] U.S. Cl. ..... 4/492; 4/513; 4/541.6; 4/904

[58] Field of Search ..... 4/492, 541.1, 541.3, 4/541.4, 541.6, 904, 488, 513

[56] References Cited

U.S. PATENT DOCUMENTS

| | | | |
|---|---|---|---|
| 520,342 | 5/1894 | Sutro | 4/904 X |
| 722,232 | 3/1903 | Hoeglauer | 4/904 X |
| 2,035,835 | 3/1936 | Raber | 4/904 X |
| 3,420,226 | 1/1969 | Berry, Sr. | 4/541.3 X |
| 3,571,818 | 3/1971 | Jacuzzi | 4/541.4 |
| 4,443,900 | 4/1984 | Remeyer | 4/541.1 X |
| 4,665,572 | 5/1987 | Davidson et al. | 4/541.3 X |
| 4,903,352 | 2/1990 | Murakami | 4/541.3 |
| 4,907,304 | 3/1990 | Davidson et al. | 4/492 X |
| 5,010,605 | 4/1991 | Shiina et al. | 4/904 X |
| 5,056,168 | 10/1991 | Mersmann | 4/541.6 |
| 5,083,329 | 1/1992 | Murakami | 4/541.4 |

FOREIGN PATENT DOCUMENTS 0090661 5/1986 Japan ..... 4/904

*Primary Examiner*—Henry J. Recla
*Assistant Examiner*—Robert M. Fetsuga
*Attorney, Agent, or Firm*—Oblon, Spivak, McClelland, Maier & Neustadt

[57] ABSTRACT

A circulating type water flow pool having a tank portion and a circulating passage formed in a lower portion thereof. The circulating passage has a riser portion at one end which extends to an upper portion of the tank portion. A delivery port is formed in the end of the circulating passage in communication with the tank portion. At its other end, the circulating passage is formed with an intake port in communication with the tank portion, and a water flow control member is mounted on the delivery port at the riser portion of the circulating passage. A screw blade of a delivery unit is actuated by a driving motor, and it is disposed facing the delivery port. Water in the circulating passage is sucked out by the screw action of the screw blade, creating a jet flow, which is delivered toward the delivery port. The jet flow is straightened by a water flow control member mounted on the delivery port, thereby creating a powerful water flow. The water jet flows into the tank portion and is introduced into the intake port formed on the other end of the tank portion. Water introduced into the intake portion moves within the circulating passage and it is again guided to the delivery port. This is repeated to forcibly and continuously circulate the water.

3 Claims, 7 Drawing Sheets

CIRULATING TYPE WATER FLOW POOL

BACKGROUND OF THE INVENTION

1. Field of the Invention

This invention relates to a water flow pool in which a flow is applied to water within a water tank, and more particularly to a so-called circulating type water flow pool in which the water flow is circulated.

2. Description of the Prior Art

It has been heretofore known that water (including cold water and hot water) within a water tank is moved, and the water is circulated to provide a circulating type water flow pool.

To this end, a delivery port and a discharge port are opposedly provided while facing the water tank, and water is delivered from the delivery port and at the sam time water is discharged from the discharge port to move water within the water tank. In addition, the delivery port and the discharge port are connected by a circulating pipe, and a delivery unit is provided at an intermediate position of the circulating pipe so as to return water from the discharge port to the delivery port to circulate a water flow.

However, the aforementioned prior art has various drawbacks in that water jetted out of the delivery port immediately reduces its vigor, and the water flow within the tank assumes a state of turbulent flow, failing to obtain an effective flow of water; and that a power loss of the delivery unit arranged within the circulating pipe is large, resulting in requirement of a large horsepower delivery unit, and effficiency of energy is poor.

SUMMARY OF THE INVENTION

This invention has been achieved in an attempt of solving the aforementioned drawbacks noted above with respect to the conventional circulating type water flow pool. A first object of this invention is to provide a circulating type water flow pool of this kind which can make an effective flow of water within a tank without reducing vigor of a jet of water from a delivery port.

A further object of this invention is to reduce a power loss of a delivery unit so as to reduce a required horsepower of the delivery unit.

The circulating type water flow pool according to this invention is configured as mentioned below for achieving the aforementioned objects.

A tank portion 1 is formed at a lower portion with a circulating passage 2 having a closed section, said circulating passage 2 having at one end a riser portion 2*a* extending toward the upper portion of the tank portion 1 and being formed with a delivery port 3 communicated with the tank portion 1, whereas said circulating passage 2 being formed at the other end with an intake port 4 communicated with the tank portion 1. In the riser portion 2*a* of the circulating passage 2, a water flow control member 12 is mounted on the delivery port 3, and a screw blade 17 of a delivery unit 6, which is operated by a driving motor 15, is disposed facing the delivery port 3.

When the delivery unit 6 is driven, water within the circulating passage 2 is drawn by the screw action of the screw blade 17 and turned into a jet flow, which is delivered toward the delivery port 3. Water jetted out of the delivery port 3 flows into the tank portion 1 and is introduced into the intake port 4 formed on the other end of the tank portion 1. Water introduced into the intake port 4 moves within the circulating passage 2 and is again guided to the delivery port 3. The aforementioned operation is repeated whereby water is circulated.

The jetted water flow is adjusted by the water flow control member 12 mounted on the delivery port 3 to create a powerful water flow.

DESCRIPTION OF THE PREFERRED EMBODIMENTS

Embodiments of a circulating type water flow pool according to the present invention will be described hereinafter with reference to the drawings.

Figure 1:
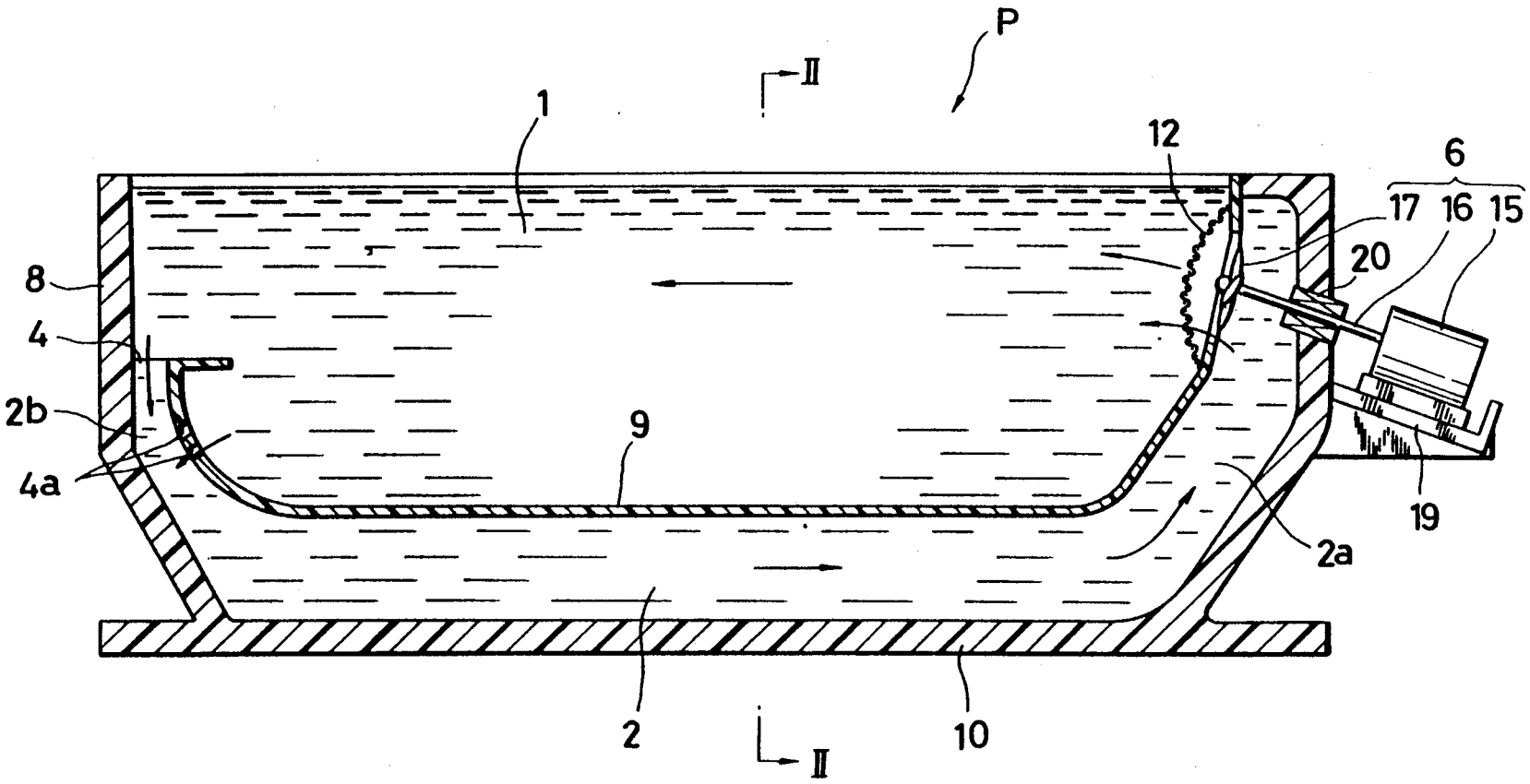
FIG. 1 is a longitudinal sectional view of one embodiment (a first embodiment) of a circulating type water flow pool according to the present invention.
Figure 2:
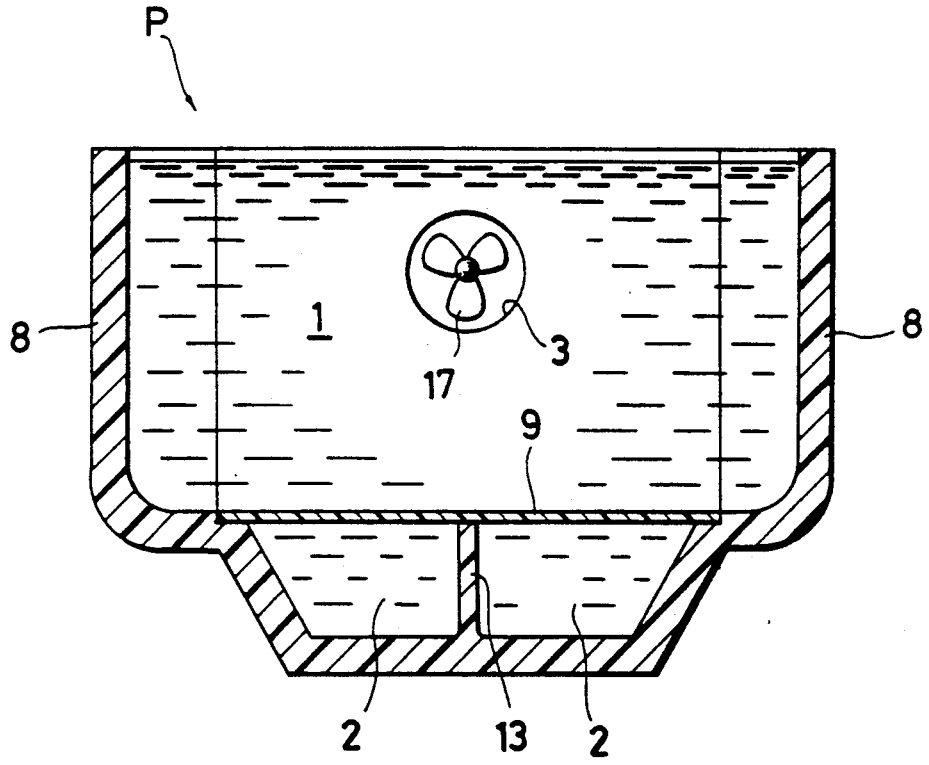
FIG. 2 is a sectional view taken on line II—II of FIG. 1.

FIG. 1 and FIG. 2 show one embodiment (a first embodiment) of a circulating type water flow pool according to the present invention. In the drawings, the arrows indicate the direction of a water flow.

As shown in FIGS. 1 and 2, a circulating type water flow pool P (hereinafter merely referred to as "water flow pool") in the present embodiment principally comprises a tank portion 1, a circulating passage 2 formed at the lower part of the tank portion 1, a delivery port 3 and an intake port 4 formed to be communicated between an end of the circulating passage 2 and the tank portion 1, and a delivery unit 6 installed facing the back surface of the delivery port 3.

Detailed structures of the aforementioned portions will be described hereinafter.

The tank portion 1 comprises a side wall portion 8 of a tank body and a partitioning wall plate 9 arranged within the tank body. The tank portion 1 is filled with water up to an upper edge portion thereof as a normal water level and has a volume enough to allow the body of a person lie down and swim. With this, a flow of water is created therein so that one may perform swimming training, or a stimulus is given to the body to maintain and promote one's health.

The circulating passage Z has a closed section and is formed between the partitioning wall plate 9 of the tank portion 1 and a base board 10 of the tank body The circulating passage 2 is reduced in lateral width as compared with the tank portion 1, the circulating passage 2 being risen at a riser portion 2*a* on one end thereof, and being bored with a delivery port 3 communicated into the tank portion 1 in the vicinity below the normal water level.

The delivery port 3 is normally circular in shape but other shapes (for example, such as a square, a rectangle, an octagon, etc.) may be freely employed. A net 12 is mounted on the front surface of the delivery port 3.

The circulating passage 2 has at the other end a minor riser portion 2*b* and is formed with an intake port 4 which opens with respect to a middle water level of the tank portion 1. A suitable grating (not shown) is provided on the intake port 4. An intake port can also be formed on the side of the riser portion 2*b* as shown at 4*a* (a small intake hole). A plurality of small intake holes 4*a* are provided.

In circulating passage 2 is provided a partitioning plate 13 lengthwise in a central portion thereof to define a water flow within the circulating passage 2 and contribute to an increase in flow velocity by reducing the cross-sectional flow area of the passage.

A delivery unit 6 is installed within the circulating passage 2 facing the delivery port 3.

More specifically, the delivery unit 6 comprises a driving motor 15, a drive shaft 16 and a screw blade 17. The driving motor 15 is placed on and secured to a receiving shelf 19 secured to the external portion of the tank portion 1 of the pool P. The drive shaft 16 of the driving motor 15 extends through a side wall 8 of the tank portion 1 through a water-tight bearing 20 and has the screw blade 17 secured to the extreme end thereof. The screw blade 17 is formed to be twisted with a predetermined curvature. Upon rotation of the screw blade 17, water is sucked from the back surface thereof due to a difference in a streamline distance flowing along curved surfaces of the front and back of the blade to extrude water toward the front surface.

The drive shaft 16 is inclined upwardly at a suitable angle (10° to 30°) with respect to a horizontal surface of the water flow pool P. Thereby, a delivery angle of the screw blade 17 is directed toward the water surface through the delivery port 3 to provide a flow closest to a water level.

While in the present embodiment, a single delvery port 3 and a single delivery unit 5 for use with a single person have been shown, it is to be noted that a plurality of such elements may be freely disposed even for use with a single person.

The water flow pool P in the present embodiment is shown for use with a single person. Incidentally, the pool P has 3700 mm of longitudinal length, 2100 mm of lateral length, and 1430 mm of height.

In the thus configured water flow pool 1 according to the present embodiment, the driving motor 15 of the delivery unit 6 is driven to rotate the screw blade 17, and water within the circulating passage 2 is drawn out by the screw action thereof and turned into a jet flow, which is delivered toward the delivery port 3. Since the screw blade 17 is directed obliquely and upwardly, the jet flow is moved upwardly of the water level and assumes a flow on the water level. The net 12 mounted on the delivery port 3 suppresses a turbulent element of the jet flow. The net 12 also serves to protect the body of a swimmer.

Water jetted out of the delivery port 3 flows into the tank portion 1 and then flows into the intake ports 4 and 4*a* formed on the other end of the tank portion 1. Water introduced to the intake port 4 moves within the circulating passage 2 and is again guided to the delivery port 3. This operation is repeated whereby water is forcibly circulated.

In a process of this forced circulation of water, the flow water increases its flow velocity in the circulating passage 2 and will not decrease the flow velocity till it rises in the riser portion 2*a*. The screw blade 17 provided at said riser portion can deliver a powerful jet flow toward the delivery port 3 and create a water flow that may be easily controlled.

As a result, the delivery unit 6 will suffice to be of small horsepower, thus improving efficiency.

Figure 3:
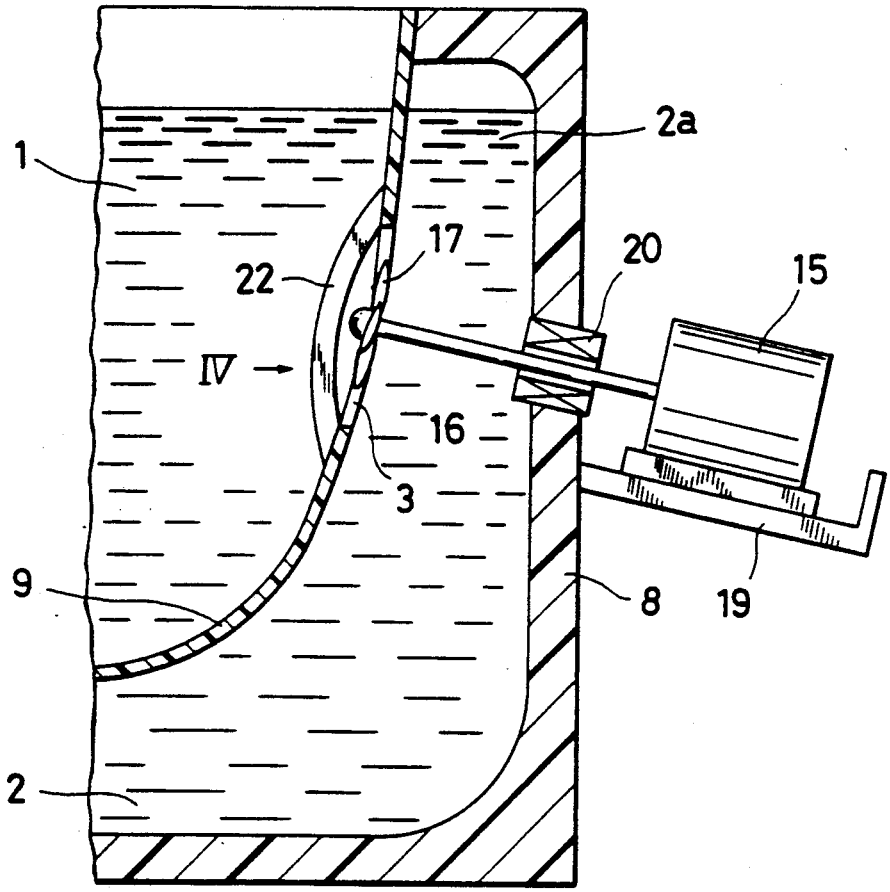
FIG. 3 is a view showing a modified form of essential parts including a water flow control member.
Figure 4:
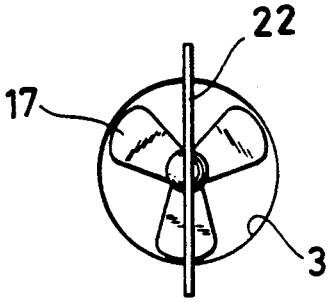
FIG. 4 is a perspective view taken along line IV of FIG. 3.
Figure 5:
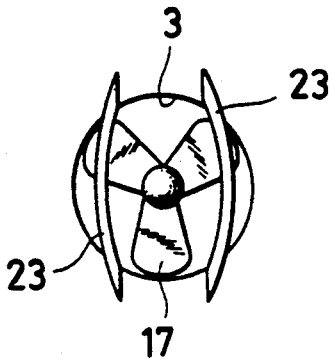
FIG. 5 is a view showing a modified form of the water flow control member.

FIGS. 3 to 5 shows a further form of a water flow control member.

In these drawings, members equal to those shown in FIGS. 1 and 2 are indicated by the same reference numerals.

In the mode shown in FIGS. 3 and 4, a single flow straightening plate 22 is arranged to be directed into the tank portion 1 in the central portion of the front surface of the delivery port 3.

The flow straightening plate 22 is not limited to one but a different mode can be employed in which two control plates 23 are aligned with minor curvature as shown in FIG. 5.

By the provision of these flow straightening plates 22 and 23, the jet flow delivered by the screw blade 17 converges which concentrates energy and creates a further powerful water flow.

Figure 6:
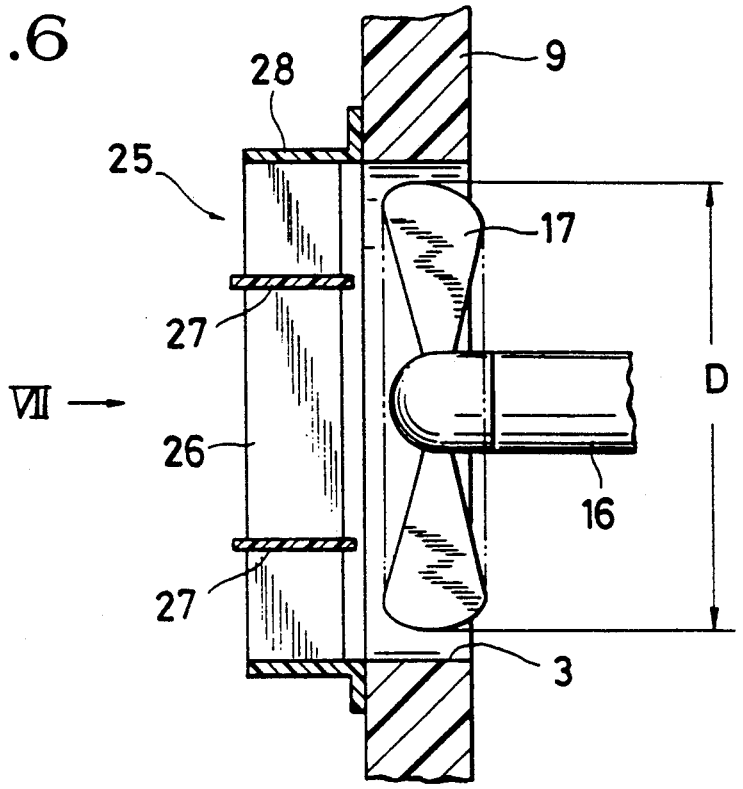
FIG. 6 is a view (a sectional view taken on line VI—VI of FIG. 7) showing a further modified form of the water flow control member.
Figure 7:
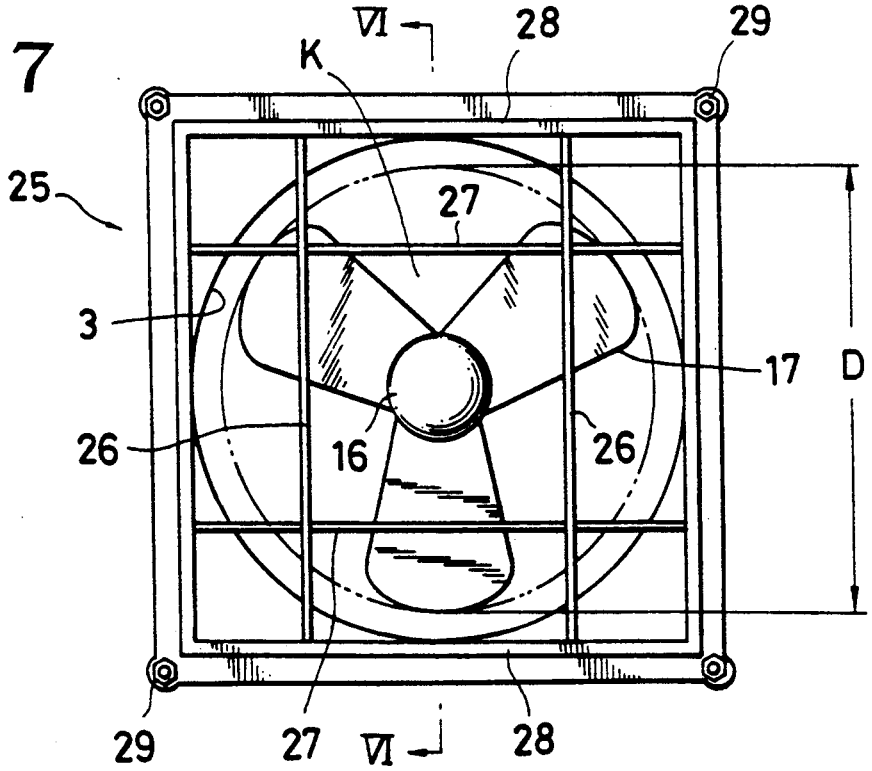
FIG. 7 is a view taken on line VII of FIG. 6.

FIGS. 6 and 7 show a still another form of the water flow control member.

This water flow control member 25 is designed so that a longitudinal flow straightening plate 26 and a lateral flow straightening plate 27, which are in the form of thin plate, are combined in a crossed manner. Reference numeral 28 designates a frame, which holds the flow straightening plates 26 and 27 and is secured to a partitioning wall plate 9 around the delivery port 3 by means of mounting bolts 29.

The water flow control member 25 is featurized in that the longitudinal and lateral flow straightening plates 26 and 27 form an internally closed defined space K, which is included in the range of a diameter D of the screw blade 17.

By using the water flow control member 25, the jet flow of the screw blade 17 is not only straightened two-dimensionally by the longitudinal and lateral flow straightening plates 26 and 27 but the jet flow converges energy in the defined space K to deliver a powerful water flow to the water tank 1. In this mode, the number of the longitudinal and lateral flow straightening plates 26 and 27 can be further increased.

Figure 8:
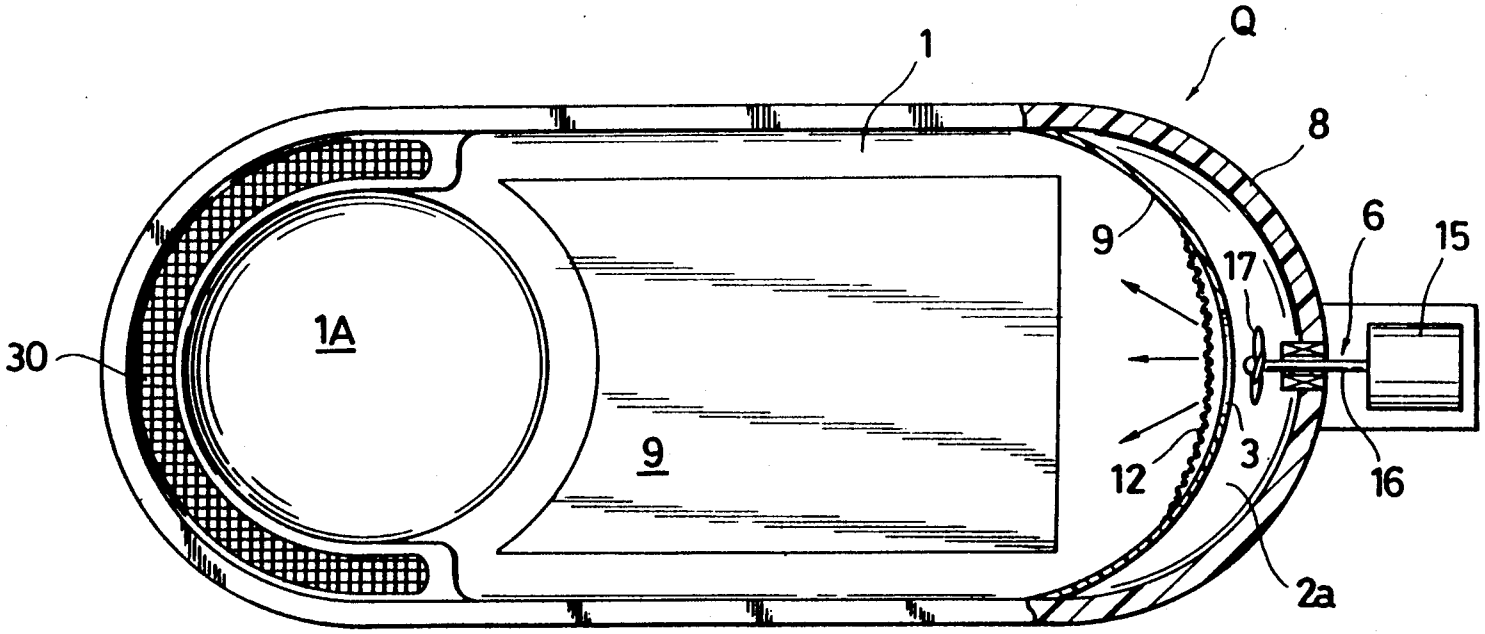
FIG. 8 is a plan view of a further embodiment (a second embodiment) of the present invention.
Figure 9:
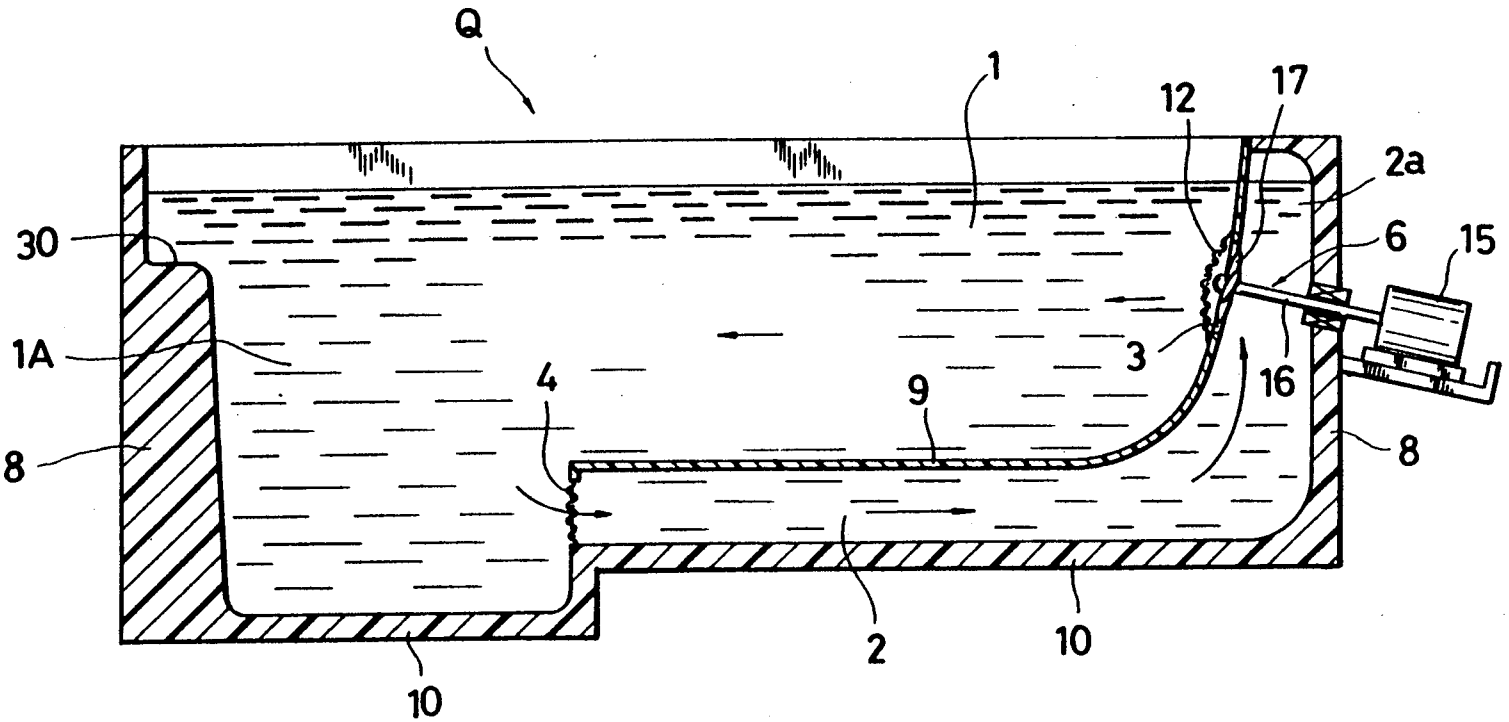
FIG. 9 is a longitudinal sectional view of FIG. 8.

FIGS. 8 and 9 show a further embodiment (a second embodiment) of the present invention. In these drawings, members equal to those shown in the previous first embodiment are indicated by the same reference numerals.

A water flow pool Q in this embodiment is featurized in that a tank portion 1 is provided with a deep water tank 1A downstream of a water flow. This deep water tank 1A constitutes a treading water portion, which further adds a health promoting function to the present water flow pool. In the drawing, reference numeral 30 designates a tile portion.

It is a natural matter of design that the water flow control members (22, 23, 25) shown in FIGS. 3 to 7 can be applied to the water flow control member 12.

Figure 10:
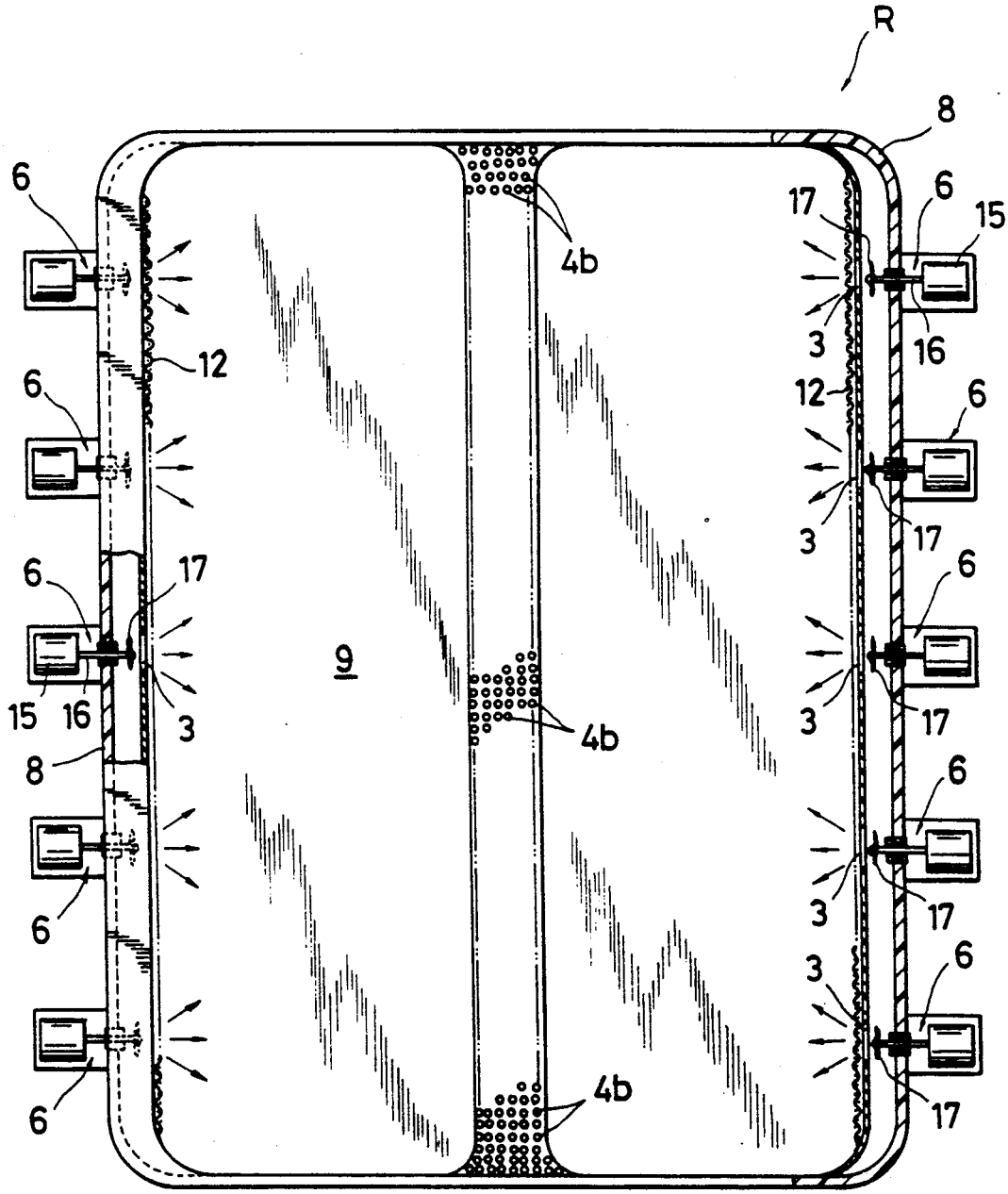
FIG. 10 is a plan view of a still another embodiment (a third embodiment) of the present invention.

FIG. 10 shows a still another embodiment (a third embodiment) of the present invention. For the reference numerals, refer to those used in the previous embodiments.

In a water flow pool R in this embodiment, there is shown a large pool for accommodating a large number of people, in which water flow is jetted through delivery ports 3 from opposite sides, and the water flow is sucked toward intake ports 4*b* formed at the bottom in the central portion of the partitioning wall plate 9.

For exchange of the water flow control member 12, refer to the previous second embodiment.

What is claimed is:

1. A circulating type water flow pool comprising:

a tank portion;

a closed circulating passage formed in a lower portion of said tank portion, said circulating passage having at one end a riser portion in communication therewith and extending to an upper portion of said tank portion where a delivery port is formed in communication with an interior of said tank portion;

an intake port formed at the other end of said circulating passage in communication therewith and with the interior of the tank portion;

a water flow control member mounted on said delivery port at the riser portion of said circulating passage; and a delivery unit including a screw blade actuated by a driving motor to circulate water through said tank portion and passage, said screw blade being disposed facing said delivery port;

wherein said tank portion includes a shallow tank portion communicating with said delivery port and having a depth and size to allow a person to swim therein, and a deep well portion in communication with said shallow tank portion and said intake port, said deep well portion having a depth and being sized to serve as a treading water portion for the swimmer.

2. A circulating type water flow pool according to claim 1 wherein said screw blade has a diameter (D) and said water flow control member comprises a pair of adjacent lateral flow straightening plates intersecting a pair of longitudinal flow straightening plates downstream of said screw blade, said lateral and longitudinal flow straightening plates defining an internally closed defined space (K) which is included in the range of said diameter (D).

3. A circulating type water flow pool according to claim 1, wherein said screw blade is arranged within the delivery port.

* * * * *